United States Patent [19]

Ben-Tal

[11] 4,382,460

[45] May 10, 1983

[54] SLATS FOR ASSEMBLY INTO DOOR OR WINDOW SHUTTERS

[76] Inventor: Ram Ben-Tal, 11 Carmel St., Ramat Hasharon, Israel

[21] Appl. No.: 323,869

[22] Filed: Nov. 23, 1981

[51] Int. Cl.[3] ..... E06B 3/12

[52] U.S. Cl. ..... 160/236

[58] Field of Search ..... 160/220, 235, 236, 232, 160/133

[56] References Cited

U.S. PATENT DOCUMENTS 2,855,039 10/1958 Gross ..... 160/236

3,633,647 1/1972 Leitgeb ..... 160/220

FOREIGN PATENT DOCUMENTS 1533951 6/1968 France ..... 160/220

*Primary Examiner*—Peter M. Caun

*Attorney, Agent, or Firm*—Toren, McGeady and Stanger

[57] ABSTRACT

A slat from which door or window shutter may be composed is made of two identically profiled strips, defining between them a concavity.

4 Claims, 2 Drawing Figures

SLATS FOR ASSEMBLY INTO DOOR OR WINDOW SHUTTERS

BACKGROUND AND FIELD OF THE INVENTION

The invention relates to slats from which shutters for doors or windows can be assembled. More specifically, the invention concerns louvre shutters which comprise a rectangular frame in which the slats are rotatably journalled. The so composed shutter may be hingedly connected to the door, window-frame, or may be horizontally slidable in top and bottom rails. The shutters are intended to give protection from light, rain and wind in closed position, and variable light and air influx through adjustment of slat position, and also as protection against unauthorized entry.

The earliest shutters of such type had been made of wood. Such shutters could well serve as a protection against sunlight, and in order to be burglary proof had to be very thick, thus heavy and expensive. A further disadvantage of wooden shutters had been that they required much maintenance by frequent painting, but in spite of that, warping and deterioration due to climatic conditions, could not be prevented.

It has been suggested—and practised to a certain extent—to make slats out of aluminium. The aluminium slats were hollow bodies manufactured by means of an extrusion process which did withstand climatic influence, particularly when anodized, but aluminium slats are most expensive.

Finally, there are known plastic slats which are manufactured also by means of an extrusion process. These are not weatherproof, and are rather weak: they can be easily broken thus giving access to an unauthorized person into the room where shutters made of such slats had been installed. Moreover, these slats are easily bendable, and a person seeking entrance into a room through a door on which a shutter of plastic slats had been provided, needs only to exert pressure from the outside of the slat, bending it so that it bulges inwardly, and as a consequence is forced out of its frame.

Where this has been done to a number of slats, these are no longer held in position, and the shutter as a whole, no longer bars entrance into the room.

OBJECT OF THE INVENTION

It is the object of the invention to provide a slat which can be used in making louvre shutters, which is composed of horizontally extending slats assembled within a rectangular frame, the framed shutter being slidable in a vertical plane or hinged to the windows or door frame.

It is a further object of the invention to provide a slat which does not have the faults and disadvantages referred to above and which can be produced at a low cost.

SHORT SUMMARY OF DISCLOSURE

According to this invention, the new slat is composed of two identically profiled strips, defining between them a concavity, and made of cold rollformed galvanized steel; the two strips when positioned facing one another with their concavities complementing each other, each strip including a portion wherein the material of the strip constitutes a fold resulting in a rib extending along the whole length of the strip, each strip having along one longitudinal edge thereof a lip extending from said edge, while the opposite edge is bent double, two complementary strips being fixedly connected along their longitudinal edges so as to form a hollow slat within which the said rib forming folds extend from one strip toward the other one.

SHORT DESCRIPTION OF THE DRAWINGS

In the annexed drawing:

FIG. 1 schematically shows the profiles of two strips positioned for connection.

FIG. 2 is a fractional perspective view of a slat composed of the two strips of FIG. 1.

DESCRIPTION OF PREFERRED EMBODIMENT

The two strips 1 and 2 indicated by end views thereof, have identical profiles but are turned through 180° (in the plane of their major extension) relative to one another. The strips are made of sheet metal, preferably steel sheet, each strip being folded double in its longitudinal direction, as seen at a. One edge of the strip is bent over on itself at b resulting in a hook-like profile. The opposite edge of the strip marked c forms a lip extending from the plane of the strip. The strips define cavities at both sides of fold a.

Figure 2:
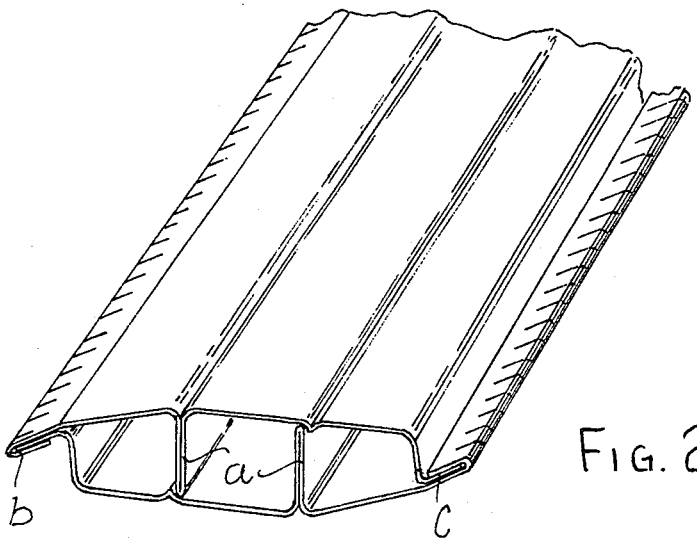
Figure 1:
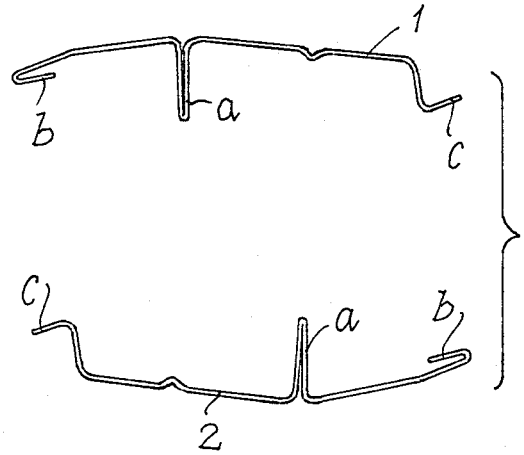

As shown before, two such strips placed opposite each other their concavities facing one another but one turned through 180° relative to the other, can be assembled to form the slat shown in FIG. 2. To achieve this the lip c of one strip is introduced into the bent over fold b of the complementary strip. The desired permanent connection is achieved by submitting the two marginal portions of the assembly to lock-seaming pressure along the whole length of the two edges.

It will be seen that such a slat cannot be bent lengthwise, since the ribs a can withstand maximal bending stress.

The strips, before being assembled to form a slat, are galvanized and enamelled, and thus become weatherproof.

The shutters made with these slats are absolute weatherproof and almost burglarproof, since a shutter made therefrom would have to be fully demolished in order to gain access into a room closed with such shutter.

I claim:

1. A structural member useful as a door or window closure consisting essentially of two mating identical longitudinal slats of cold-formed metal, said mating slats being assembled in facing opposed relationship in a reversed orientation relative to each other, each of said mating slats comprising:

a first edge folded upon itself to form a recess extending longitudinally along substantially the entire length of said slat and receiving therein in fitted engagement a lip member formed in the other of said mating slats;

a second edge located on the side of said slat opposite said first edge and formed to define a lip member extending substantially along the entire length of said slat, said lip member being arranged in fitted engagement within said recess formed along said folded first edge of said other slat; and a rib member extending longitudinally of said slat essentially along the entire length thereof and protruding laterally from one said of said slat generally perpendicularly thereto, said rib member being formed by shaping said slat bent upon itself so that said slat is formed with parts thereof extending essentially in generally parallel relationship to form said rib member as a double-walled protruberance extending outwardly from said slat along the length thereof;

said rib member being located in each of said mating slats approximately one-third of the distance between said first edge and said second edge and closest to one only of said recess or said lip member, said rib member in each of said slats being always closest to the same one of said recess or said lip member so that when said mating slat members are assembled together, the rib member in one will extend across the interior of said structural member to the other mating slat, said structural member being thereby formed as a hollow piece having two approximately equally spaced longitudinal rib members extending across the enterior thereof with the lip member of each of said two mating slats being engaged in the recess of the other of said mating slats.

2. A method for forming a longitudinal slat of cold-formed metal, said slat being adapted to be assembled in facing opposed relationship with a second identical mating slat in reversed orientation relative thereof in order thereby to form a structural member useful as a door or window closure consisting essentially of two of said mating identical longitudinal slats, said method comprising the steps of:

cutting a generally flat, planar strip of sheet metal into a base member having a generally longitudinal orientation with a first longitudinal edge and with a second longitudinal edge opposite said first longitudinal edge;

folding said first edge upon itself to form a recess extending longitudinally along substantially the entire length of said slat, said recess being adapted to receive therein in fitted engagement a lip member formed in a mating identical slat;

bending said second edge to form therealong a lip member extending substantially along the entire length of said slat, said lip member being adapted to be arranged in fitted engagement within a recess formed along a folded first edge of another identical slat when a pair of said identical slats are arranged in assembled engagement with each other; and bending said strip of sheet metal to form therein a rib member extending longitudinally essentially along the entire length of said sheet metal strip and protruding laterally from one side thereof generally perpendicularly thereto, said rib member being formed by shaping said sheet metal member bent upon itself so that said slat formed therefrom is configured with parts thereof extending essentially in generally parallel relationship to form said rib member as a double-walled protuberance extending outwardly from said sheet metal strip along the length thereof;

said rib member being located approximately one-third of the distance between said first edge and said second edge and closest to one of said recess or said lip member so that when said slat is placed in assembled engagement with a mating slat, the rib member in one of said slats will extend across the interior of a structural member thus formed to the other of said mating slats in order thereby to enable said structural member to be formed as a hollow piece having two approximately equally spaced longitudinal rib members extending across the interior thereof with the lip member of each of said two mating slats being arranged in the recess of the other of said mating slats.

3. A method according to claim 2 comprising the further step of assembling a pair of said identical mating slats together in order to form said structural member by inserting the lip member of each of said slats into the recess in the other of said slats.

4. A longitudinal slat formed as a unitary integral member by bending a longitudinal piece of cold-formed sheet metal, said slat being adapted to be assembled with an identical mating longitudinal slat in facing opposed relationship but in a reversed orientation relative thereto in order thereby to form said two mating identical slats as a structural member useful as a door or window closure, said longitudinal slat comprising:

a first edge folded upon itself to form a recess extending longitudinally along substantially the entire length of said slat and adapted to receive therein in fitted engagement a lip member formed in a mating identical slat;

a second edge located on the side of said slat opposite said first edge formed to define a lip member extending along substantially the entire length of said slat, said lip member being adapted to be arranged in fitted engagement within a recess formed along a folded first edge of another mating identical slat when said slat is arranged in assembled engagement with said another identical mating slat; and a rib member extending longitudinally of said slat essentially along the entire length thereof and protruding laterally from one side of said slat generally perpendicularly thereto, said rib member being formed by shaping said slat bent upon itself so that said slat is formed with portions thereof extending essentially in generally parallel relationship to form said rib member as a double-walled protruberance extending outwardly from said slat along the length thereof;

said rib member being located approximately one-third of the distance between said first edge and said second edge of said slat and closest to one only of said recess or said rib member; so that when said slat is arranged in assembled engagement with a mating identical slat with the lip member of said slat arranged in fitted engagement within the recess of said other identical mating slat and with the recess of said slat receiving therein in fitted engagement the lip member of said another mating slat, said structural member may thereby be formed as a hollow piece having two approximately equally spaced longitudinal rib members extending across the interior thereof, each of said rib members being integrally formed with one only of said identical mating slats.

* * * * *